US007240407B2

(12) United States Patent
Kawai et al.

(10) Patent No.: US 7,240,407 B2
(45) Date of Patent: Jul. 10, 2007

(54) SEAT BELT APPARATUS AND BUCKLE

(75) Inventors: Yoshihiko Kawai, Hikone (JP); Takaaki Kimura, Hikone (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 11/130,266

(22) Filed: May 17, 2005

(65) Prior Publication Data

US 2005/0257354 A1 Nov. 24, 2005

(30) Foreign Application Priority Data

May 18, 2004 (JP) ..... 2004-147319

(51) Int. Cl.
*A44B 11/26* (2006.01)

(52) U.S. Cl. ..... 24/641; 24/640; 24/642; 24/643

(58) Field of Classification Search ..... 24/641, 24/642, 643, 640, 633
See application file for complete search history.

(56) References Cited

U.S. PATENT DOCUMENTS 5,357,658 A * 10/1994 Tanaka ..... 24/641
6,035,500 A * 3/2000 Kawai et al. ..... 24/641
6,216,323 B1 * 4/2001 Oyamada ..... 24/641
6,370,742 B1 * 4/2002 Yamaguchi et al. ..... 24/641
6,438,810 B2 * 8/2002 Rogers et al. ..... 24/641
6,588,077 B2 * 7/2003 Katsuyama et al. ..... 24/641
6,931,696 B2 * 8/2005 Lee et al. ..... 24/633

FOREIGN PATENT DOCUMENTS

EP 0 318 031 5/1989
EP 0 368 277 5/1990

* cited by examiner

*Primary Examiner*—Robert J. Sandy
*Assistant Examiner*—Marcus Menezes
(74) *Attorney, Agent, or Firm*—Foley and Lardner LLP

(57) ABSTRACT

A buckle that is compact in a longitudinal direction and uses an unlatching force that may be effectively applied to a latch member when releasing a tongue from a buckle. The buckle is configured so that as an operation button is manipulated in the unlatching direction from a state in which a tongue and a latching portion of a latch member are latched, the slider moves so that the inclined face of a pressed portion of the slider comes in contact with the inclined face of a pressing portion of an ejector and presses the ejector. Then, the ejector is spaced from the tongue and the biasing force of an ejector spring is effectively applied to the latch member via the ejector and the slider in the unlatching direction. An unlatching force is thereby applied to the latch member so that the latch member pivots in the unlatching direction, causing release of the tongue.

16 Claims, 5 Drawing Sheets

SEAT BELT APPARATUS AND BUCKLE

BACKGROUND

The present invention relates to a buckle to be used in a seat belt apparatus and a seat belt apparatus which is installed in a seat of an automobile or other vehicle that employs the buckle.

Conventionally, seats of various vehicles such as automobiles are equipped with seat belt apparatuses for protecting occupants in the event of an emergency such as a vehicle collision. Such a seat belt apparatus is normally provided with a buckle in order to facilitate an occupant putting on and removing the seat belt apparatus. Generally, the buckle is latched with a tongue which is slidably supported to a seat belt, whereby the seat belt can restrain the occupant.

A buckle has been proposed in Japanese Unexamined Patent Publication No. 2001-063515 (incorporated by reference herein) in which, for latching a tongue into the buckle, a latch member pivots so that a latch portion formed at an end of the latch member is inserted into a latch hole of the tongue, the tongue is held in the state latched with the latch portion by an ejector with the biasing force of an ejector spring, and the latch member is held in the latched state by a slider to prevent the latch member from moving in a unlatching direction and a lock pin for depressing the slider in a state to prevent the movement of the latch member in the unlatching direction, while, for releasing the tongue from the buckle, the lock pin is moved by an unlatching operation with an operation button to cancel the latched state of the latch member, and the ejector causes the latch member to pivot in a unlatching direction and push out the tongue from the buckle with the biasing force of the ejector spring.

In such a buckle, because the ejector causes the latch member to pivot when releasing the tongue from the buckle, it is desired to effectively apply the biasing force of the ejector spring as an unlatching force to the latch member. For this purpose, because the biasing force of the ejector spring is applied to the end of the latch member via the ejector in the aforementioned buckle, it is conceivable to construct a straight line connecting the end (a portion to which the biasing force of the ejector spring is applied) of the latch member and the pivotal axis of the latch member in a perpendicular orientation to the moving direction of the ejector as possible.

However, to achieve this the buckle must be long in the longitudinal direction because the pivot path of the end of the latch member projects largely toward a tongue insertion opening when the latch member pivots. Alternatively, it is conceivable to simply increase the unlatching force in order to improve the releasing performance between the tongue and the buckle. However, as the unlatching force is increased the slider and the lock pin receive the increased unlatching force. To compensate this, the strength of the slider and the lock pin must be increased.

Therefore, it is difficult to effectively apply the biasing force of the ejector spring to the latch member in the conventional buckle because the conventional buckle has a limitation in making the aforementioned straight line nearly perpendicular to the moving direction of the ejector without increasing the length of the buckle in the longitudinal direction and without increasing the strength of the slider.

It is also desired to improve the comfort to occupant wearing the seat belt as much as possible.

SUMMARY

An object of an embodiment of the present invention is to provide a buckle which can effectively apply unlatching force to a latch member when a tongue is released from the buckle while the buckle is still compact in the longitudinal direction. Another object of an embodiment of the present invention is to provide a buckle which can provide increased unlatching force to be applied to a latch member. Still another object of an embodiment of the present invention is to provide a seat belt apparatus which can provide an occupant with improved comfort when wearing a seat belt.

According to an embodiment of the present invention, a buckle includes a base having side walls, a latch member that adapted to be supported by the side walls so that the latch member can pivot between an unlatching position and a latching position, wherein the latch member includes a latching portion which is adapted to engage with a tongue when the tongue is inserted into a predetermined position within the buckle and the latch member pivots to the latching position, a slider that is adapted to prevent said latch member from moving in the unlatching direction when the tongue and the latch member are latched, a slider spring which is disposed between the slider and the latch member and is adapted to be compressed by the slider and the latch member, an operation member which is attached to said side walls of the base such that the operation member can move in the longitudinal direction of the buckle, and is adapted to cause said slider to move in the unlatching direction of said latch member by an unlatching operation, an ejector for releasing said tongue, an ejector spring for biasing said ejector in a direction to release the tongue, and wherein said slider is supported to said latch member so as to allow relative movement, and said ejector includes an unlatching force applying portion that is adapted to apply the unlatching force to said slider when said latch member is caused to move in the unlatching direction by the movement of said slider relative to said latch member due to the unlatching operation of said operation member.

According to an embodiment of the present invention, a seat belt device includes a seat belt to be worn by an occupant, a tongue movably supported to the seat belt, a buckle to which the tongue is latched, in which the tongue is latched to the buckle whereby the seat belt is fastened to the occupant, wherein the buckle includes a base having side walls, a latch member that adapted to be supported by the side walls so that the latch member can pivot between an unlatching position and a latching position, wherein the latch member includes a latching portion which is adapted to engage with a tongue when the tongue is inserted into a predetermined position within the buckle and the latch member pivots to the latching position, a slider that is adapted to prevent said latch member from moving in the unlatching direction when the tongue and the latch member are latched, a slider spring which is disposed between the slider and the latch member and is adapted to be compressed by the slider and the latch member, an operation member which is attached to said side walls of the base such that the operation member can move in the longitudinal direction of the buckle, and is adapted to cause said slider to move in the unlatching direction of said latch member by an unlatching operation, an ejector for releasing said tongue, an ejector spring for biasing said ejector in a direction to release the tongue, and wherein said slider is supported to said latch member so as to allow relative movement, and said ejector includes an unlatching force applying portion that is adapted to apply the unlatching force to said slider when said latch member is caused to move in the unlatching direction by the movement of said slider relative to said latch member due to the unlatching operation of said operation member.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

FIG. 2(*b*) is a longitudinal sectional view of a buckle in a state where the buckle is latched to the tongue, according to an embodiment of the present invention.

FIG. 3(*b*) is a perspective view taken in a direction IIIB in FIG. 1.

FIG. 5(*b*) is a sectional view taken along a line VB—VB in FIG. 5(*a*).

DETAILED DESCRIPTION

Figure 1:
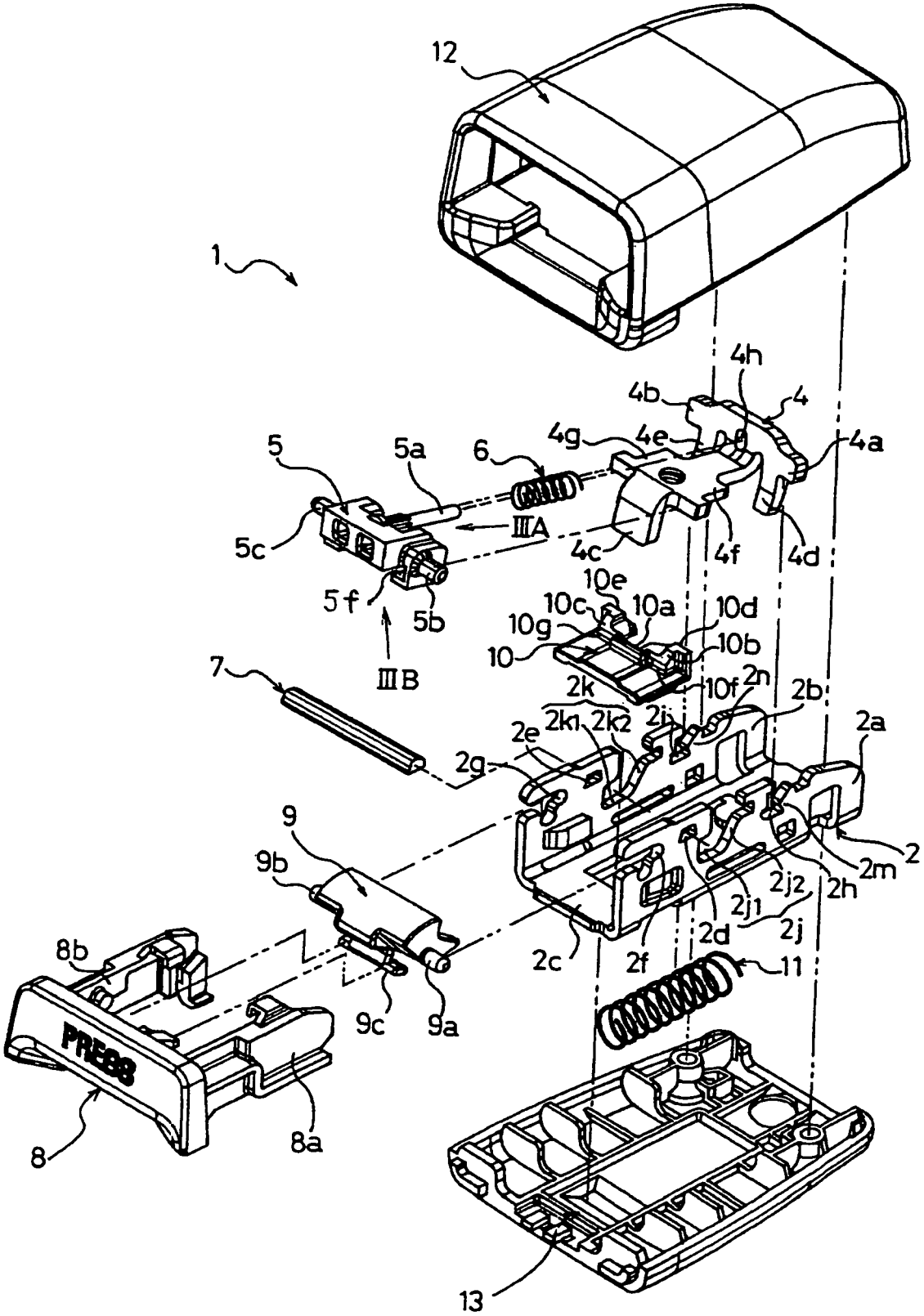
FIG. 1 is an exploded perspective view showing an embodiment of a buckle according to the present invention.

Embodiments of the present invention will be described below with reference to the drawings. It should be noted that, in the following description, terms "upper", "lower", "above", and "below" refer to "upper", "lower", "above", and "below" in the drawings, respectively, terms "right", "left", "rightward, and "leftward" refer to "right", "left", "rightward, and "leftward" as seen from a slider 5 side to a operation button 8 side in FIG. 1 or refer to "right", "left", "rightward, and "leftward" in the other drawings, respectively.

Figure 2A:
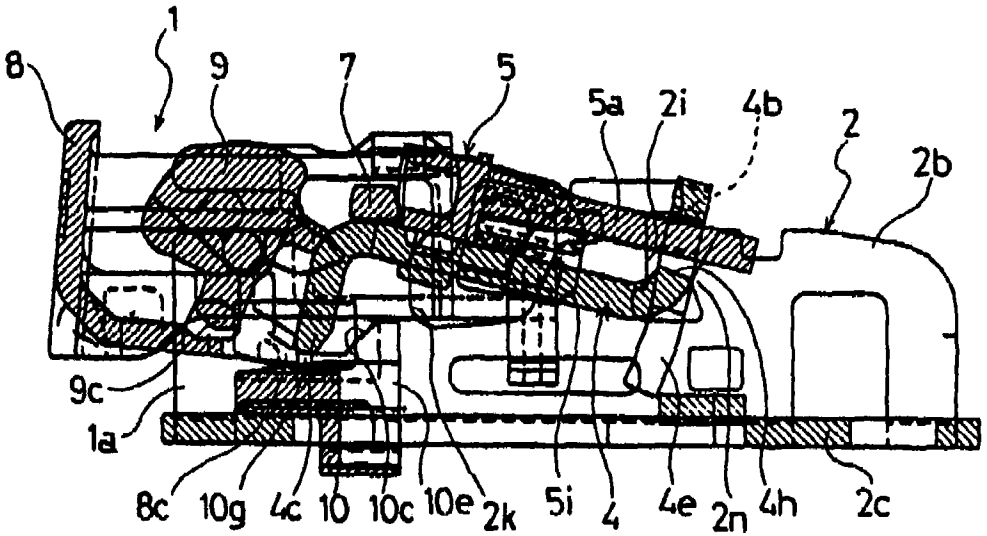
FIG. 2(*a*) is a longitudinal sectional view of a buckle in a state where the buckle is not latched with a tongue, according to an embodiment of the present invention.
Figure 2B:
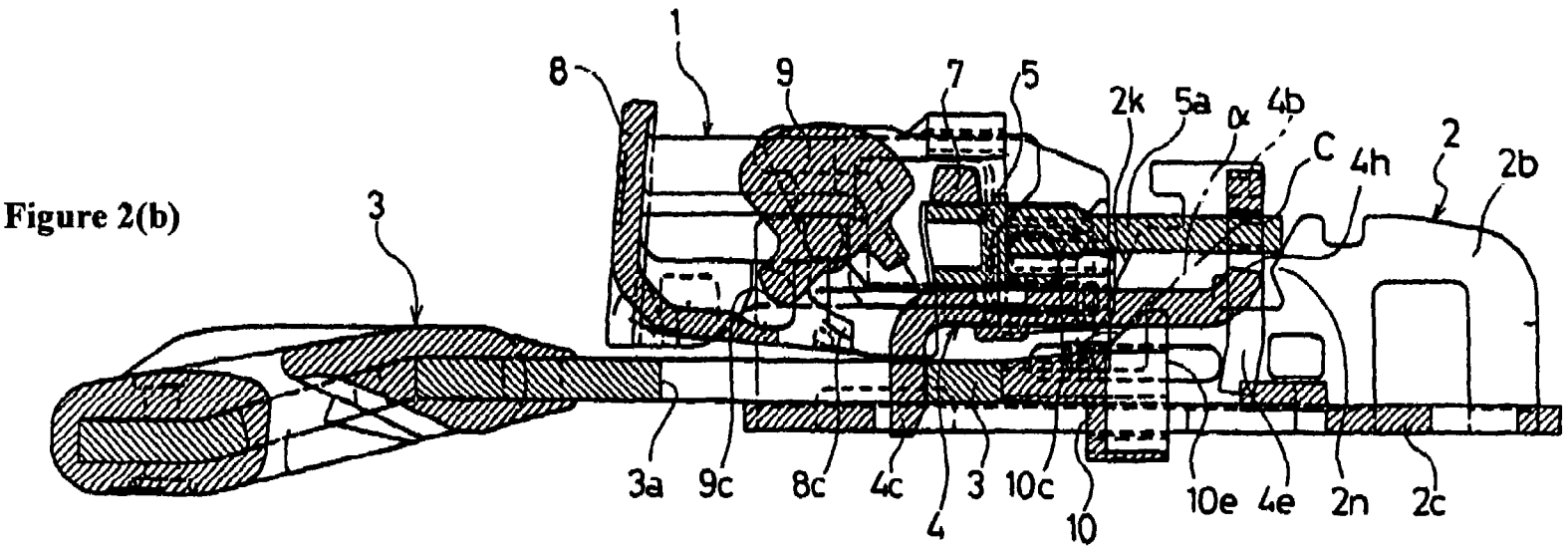

FIG. 1 and FIGS. 2(*a*), 2(*b*) show a buckle 1 according to an embodiment of the present invention. The buckle 1 may include a base 2 having a U-shaped frame with two side walls 2*a*, 2*b* and a bottom 2*c*; a latch member 4 which is pivotally supported by the side walls 2*a*, 2*b* of the base 2, for latching a tongue 3; a slider 5 movably disposed on an upper surface of the latch member 4, for preventing the latch member 4 from moving in the unlatching direction when the tongue 3 and the latch member 4 are latched; a slider spring 6 which is disposed and compressed between the slider 5 and the latch member 4 to always bias the slider 5 in a direction toward a lock pin 7 (as will be described later); the lock pin 7 which is supported by holes 2*d*, 2*e* of the both side walls 2*a*, 2*b* of the base 2, for depressing (locking) the upper surface of the slider 5 which prevents the latch member 4 from moving in the unlatching direction when the tongue 3 and the latch member 4 are latched; an operation button 8 (corresponding to an operation member of the present invention) which is attached to the two side walls 2*a*, 2*b* of the base 2 so that the operation button 8 can move in the longitudinal direction; an inertia lever 9 which is positioned between the operation button 8 and the latch member 4 and is pivotally supported by the grooves 2*f*, 2*g* of the both side walls 2*a*, 2*b* of the base 2, an ejector 10 which is disposed on the bottom 2*c* of the base 2 so as to allow movement of the ejector 10 in the longitudinal direction of the base 2 and can release the tongue 3 from the buckle 1; an ejector spring 11 which always biases the ejector 10 in a direction releasing the tongue 3 from the buckle 1; and an upper cover 12 and a lower cover 13 which are constructed to engage each other to cover the base, to which the above components are assembled, from the top and from the bottom. It should be noted that springs 6, 11 are omitted in FIGS. 2(*a*) and 2(*b*).

The latch member 4 has pivot shaft portions 4*a*, 4*b* which are pivotably supported by the supporting grooves 2*h*, 2*i* formed in the both side walls 2*a*, 2*b* of the base 2, respectively. The latch member 4 is provided, on a side opposite to the pivot shaft portions 4*a*, 4*b* in the longitudinal direction of the buckle 1, with a latching portion 4*c* which can engage the tongue 3. The latch member 4 is also provided, beneath the pivot shaft portions 4*a*, 4*b*, with first and second pressed portions 4*d*, 4*e* which can be pressed by the ejector 10 and is provided, on lateral side ends between the pivot shaft portions 4*a*, 4*b* and the latching portion 4*c*, with rail portions 4*f*, 4*g* for guiding the slider 5.

Figure 3A:
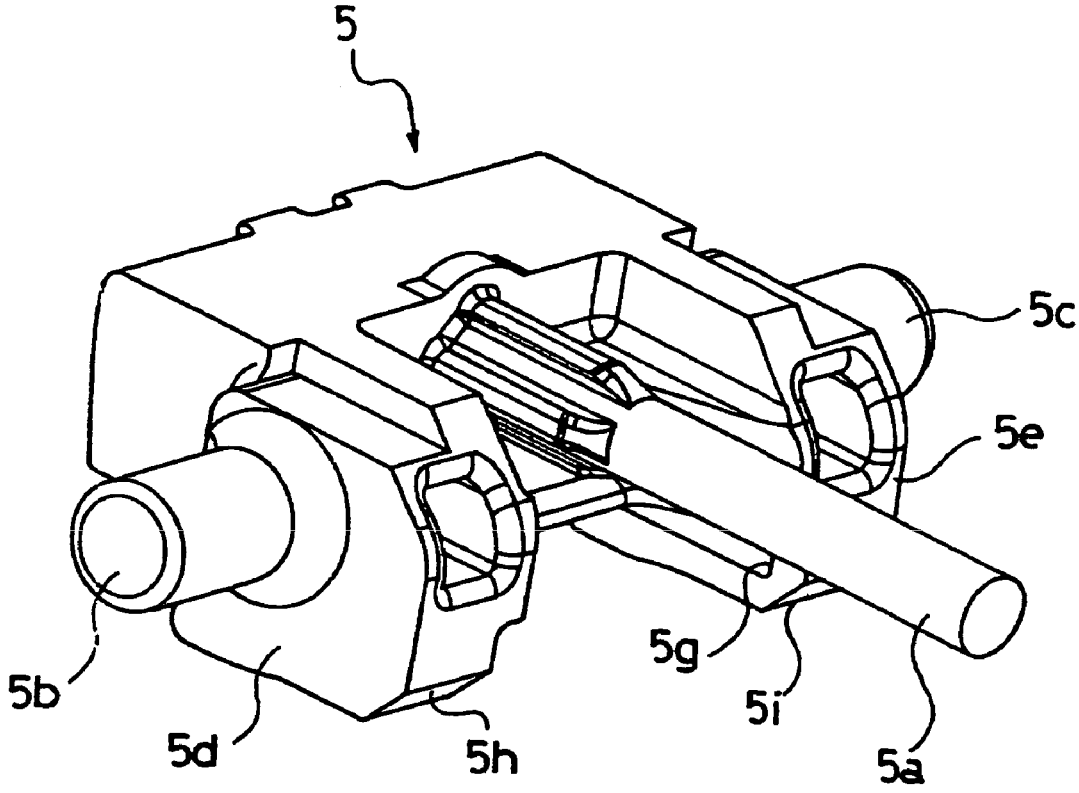
FIG. 3(*a*) is a perspective view taken in a direction IIIA in FIG. 1.
Figure 3B:
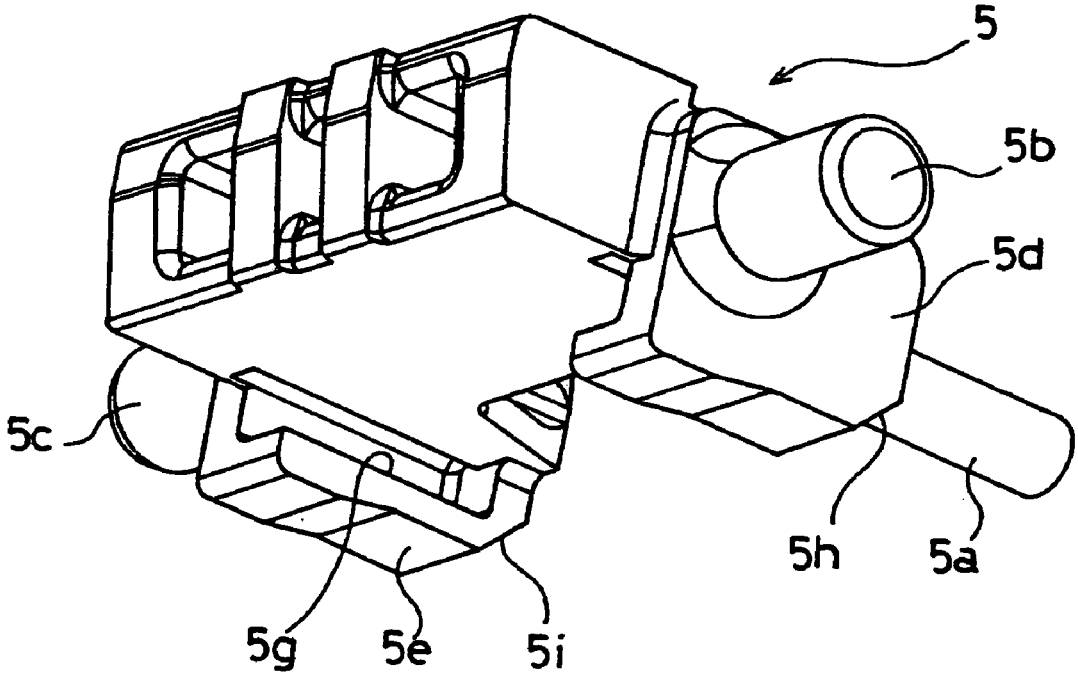

As shown in FIG. 1 and FIGS. 3(*a*), 3(*b*), the slider 5 is provided at its center with a projecting shaft 5*a* extending in the longitudinal direction of the buckle 1. The projecting shaft 5*a* is constructed to extend through a hole 4*h* of the latch member 4. The slider spring 6 is overlaid on the projecting shaft 5*a* so that the slider spring 6 is disposed and compressed between the latch member 4 and the slider 5. Therefore, by the slider spring 6, the latch member 4 is always biased in the clockwise direction and the slider 5 is always biased toward the lock pin 7.

The slider 5 has a pair of left and right engaging shafts 5*b*, 5*c*. The engaging shafts 5*b*, 5*c* are formed to project leftward and rightward from a pair of left and right guide portions 5*d*, 5*e*, respectively. The engaging shafts 5*b*, 5*c* are engaged and supported by engaging grooves 2*j*, 2*k* formed in the both side walls 2*a*, 2*b* of the base 2 in such a manner as to project outward a predetermined amount from the both side walls 2*a*, 2*b*. In this connection, the engaging grooves 2*j*, 2*k* are composed of first groove portions $2j_1$, $2k_1$, extending in the longitudinal direction of the buckle 1 (that is, the moving direction of the operation button 8) and second groove portions $2j_2$, $2k_2$ extending obliquely from the first groove portions $2j_1$, $2k_1$ to open the upper ends, respectively. In the normal operation, the engaging shafts 5*b*, 5*c* of the slider 5 are allowed to move along the first groove portions $2j_1$, $2k_1$. In the forcible releasing operation, the engaging shafts 5*b*, 5*c* are allowed to move along the first groove portions $2j_1$, $2k_1$ and the second groove portions $2j_2$, $2k_2$, respectively.

It should be noted that, the both side walls 2*a*, 2*b* of the buckle 1, including the respective grooves and holes, are constructed to be symmetrical with respect to the longitudinal center line of the buckle 1.

The guide portions 5*d*, 5*e* are provided with guide grooves 5*f*, 5*g*, respectively. The guide grooves 5*f*, 5*g* are slidably fitted in the left and right rail portions 4*f*, 4*g* of the latch member 4, thereby allowing the slider 5 to slide along the rail portions 4*f*, 4*g*.

Further, the guide portions 5*d*, 5*e* have pressed portions (corresponding to the contact portions of the present invention) 5*h*, 5*i*, respectively. The pressed portions 5*h*, 5*i* are composed of inclined faces formed at corners between the ends on the projecting shaft 5*a* side and the bottoms of the guide portions 5*d*, 5*e*, respectively. As will be described later, the pressed portions 5*h*, 5*i* are pressed by first and second pressing portions (corresponding to the unlatching force applying portions of the present invention) 10*b*, 10*c*, which are composed of inclined faces, of the ejector 10, whereby the slider 5 and the latch member 4 are urged in such a direction when the latching portion 4*c* is unlatched from the tongue 3.

Figure 4:
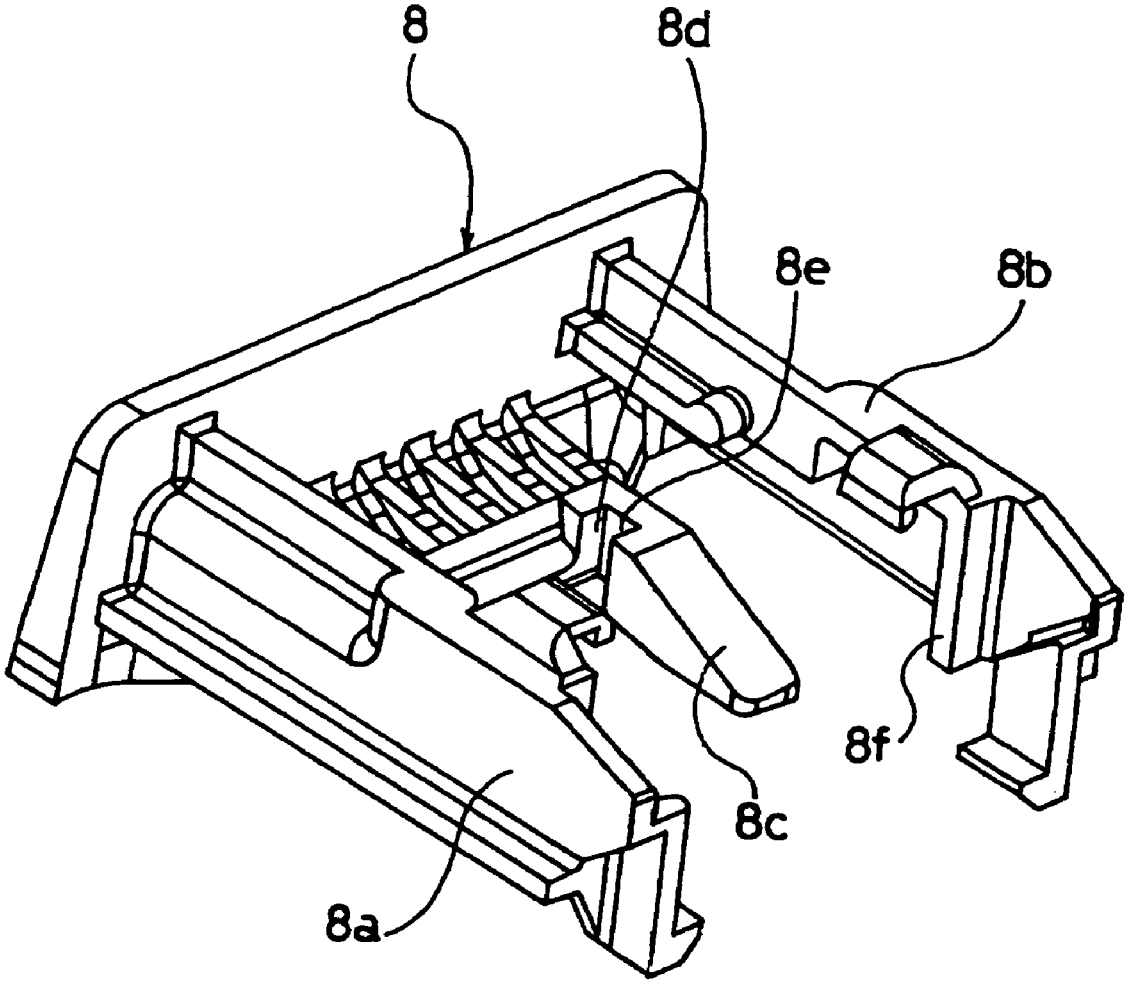
FIG. 4 is a perspective view showing an operation button of the buckle shown in FIG. 1.

The operation button 8 has left and right side walls 8*a*, 8*b* extending in the longitudinal direction of the buckle 1 and has left and right projecting portions 8*c* (though one of the projecting portions 8*c* is shown and the other projecting portion is not shown, the projecting portions will be both designated with the numeral "8*c*" for the convenience of the following explanation) extending in the longitudinal direction between the side walls 8*a*, 8*b* as shown in FIG. 1 and FIG. 4. Formed in inner surfaces of the projecting portions 8*c* facing each other are button-side first connecting portions 8*d* (hereinafter, similarly, the button-side first connecting portions will be both designated with the numeral "8*d*") composed of vertical faces (perpendicular to the moving direction of the operational button) and button-side second connecting portions 8*e* (hereinafter, similarly, the button-side second connecting portions will be both designated with the numeral "8*e*") composed of vertical faces parallel to the above vertical faces as shown in FIG. 4.

As shown in FIG. 4, formed in inner surfaces of the side walls 8*a*, 8*b* are press portions 8*f* (hereinafter, similarly, the press portions will be both designated with the numeral "8*f*") composed of vertical faces which press the engaging shafts 5*b*, 5*c* of the slider 5 to move the slider 5 in the unlatching direction when the operation button 8 is moved in the unlatching direction. Both side walls 8*a*, 8*b* of the operation button 8 are formed to be symmetrical with respect to the longitudinal center line of the buckle 1.

The inertia lever 9 has a pair of pivot shafts 9*a*, 9*b* which are pivotably fitted in the grooves 2*f*, 2*g* of the side walls 2*a*, 2*b* of the base 2. The inertia lever 9 also has a lever-side connecting portion 9*c* having a rhomboid section. One end of the lever-side connecting portion 9*c* comes in contact with the button-side first connecting portion 8*d* or the button-side second connecting portion 8*e* on the right side of the operation button 8, while the other end of the lever-side connecting portion 9*c* comes in contact with the button-side first connecting portion 8*d* or the button-side second connecting portion 8*e* on the left side of the operation 8. Therefore, the inertia lever 9 and the operation button 8 are engaged with each other to allow the relative rotation.

In this connection, the distance between the connecting position of the lever-side connecting portion 9*c* relative to the button-side second connecting portion 8*e* and the pivotal axis of the inertia lever 9 is set to be larger than the distance between the connecting position of the lever-side connecting portion 9*c* relative to the button-side first connecting portion 8*d* and the pivotal axis of the inertia lever 9. By this setting, torque by inertia force of the operation button 8 is smaller than torque of the inertia lever itself when inertia force in the rightward direction (unlatching direction) acts on the operation button 8 and the inertia lever 9 so that the lever-side connecting portion 9*c* is engaged with the button-side first connecting portion 8*d*. In addition, torque by inertia force of the operation button 8 is larger than torque of the inertia lever itself when inertia force in the leftward direction (non-unlatching direction) acts on the operation button 8 and the inertia lever 9 so that the lever-side connecting portion 9*c* is engaged with the button-side second connecting portion 8*e*.

In the normal operation, the lever-side connecting portion 9*c* of the inertia lever 9 comes in contact with the vertical faces of the button-side second connecting portions 8*e*. In this state, the center of gravity of the inertia lever 9 is positioned above the pivot shafts 9*a*, 9*b*.

The inertia lever 9 is provided for the purpose of preventing the movement of the operation button 8 in the unlatching direction when the operation button 8 of the buckle 1 is subjected to inertia force either in the unlatching direction or in the non-unlatching direction in a state that the tongue 3 is latched by the buckle 1 as shown in FIG. 2(*b*). Since the detail structure of the inertia lever 9 and the action of the inertia lever 9 do not directly relate to the present invention, the description about these will be omitted.

As shown in FIG. 1, the ejector 10 has a standing wall 10*a* which is disposed on an edge opposite to a side of the tongue insertion opening 1*a* of the buckle 1 that projects upwards. The first and second pressing portions 10*b*, 10*c* which are composed of inclined faces are provided on the left and right sides of the standing wall 10*a*. The first and second pressing portions 10*b*, 10*c* are disposed to face the pressed portions 5*h*, 5*i* of the slider 5 in the assembled state of the buckle 1.

FIG. 2(*b*) shows an example of the buckle 1 when the latch member 4 is in the latched position and the latching portion 4*c* of the latch member 4 is engaged with the tongue 3 and the ejector 10 comes in contact with and presses the tongue 3. The inclination of the inclined faces of the first and second pressing portions 10*b*, 10*c* is set to have such an angle as shown by an extension line $\alpha$ from the inclined face, as shown by a double-dashed line passing through or close to the pivotal axis C in FIG. 2(*b*). Similarly, the inclination of the inclined faces of the pressed portions 5*h*, 5*i* is set to have the same angle so that the inclined faces of the first and second pressing portions 10*b*, 10*c* and the inclined faces of the pressed portions 5*h*, 5*i* are parallel to each other in the assembled state of the buckle 1. Therefore, the inclination of the inclined faces of the pressed portions 5*h*, 5*i* is set to have such an angle with the extension line (coinciding with the extension line $\alpha$) of the inclined faces that passes through or close to the pivotal axis C of the pivot shaft portions 4*a*, 4*b* of the latch member 4 when the latch member 4 is in latched position as shown in FIG. 2(*b*), and the slider 5 is moved rightward and the pressed portions 5*h*, 5*i* come in contact with the first and second pressing portions 10*b*, 10*c*.

In an embodiment of the present invention, the angle of inclination of the inclined faces of the first and second pressing portions 10*b*, 10*c* and the angle of inclination of the inclined faces of the pressed portions 5*h*, 5*i* may be both set to be 45 degrees or about 45 degrees relative to the bottom 2*c* of the base 2 in order to effectively transmit force from the first and second pressing portions 10*b*, 10*c* to the pressed portions 5*h*, 5*i* and to smoothly move the slider 5 in the longitudinal direction. Other angles may also be selected as well.

The ejector 10 also has third and fourth pressing portions 10*d*, 10*e*, which may be vertical faces and may be formed on edges on both the left and right sides of the standing wall 10*a*. The third and fourth pressing portions 10*d*, 10*e* are constructed to press the first and second pressed portions 4*d*, 4*e* of the latch member 4 to cause the latch member 4 to pivot in the unlatching direction, as shown in FIG. 2(*a*). The ejector 10 further has fifth and sixth pressing portions 10*f*, 10*g* which are formed on left side, as seen in FIG. 2(*a*), of the first and second pressing portions 10*b*, 10*c*, that is, on the operation button 8 side. The fifth and sixth pressing portions 10*f*, 10*g* press the left and right projecting portions 8*c* of the operation button 8.

The buckle 1 of this embodiment having the aforementioned structure can be used in a conventionally well known seat belt apparatus which comprises at least a seat belt (not shown) to be worn by an occupant, a tongue 3 movably supported to the seat belt, and a buckle 1 to which the tongue 3 is latched, wherein the tongue 3 is latched to the buckle 1 whereby the seat belt is fastened to the occupant.

A description will now be made as to an exemplary method of manufacturing the tongue to be latched to the buckle 1 in a seat belt apparatus employing the buckle 1 of this embodiment. As one example of the method of manufacturing the tongue 3, metal that is to serve as the base is twice plated with nickel. The nickel-plated metal may be further plated with a mixture of tin and nickel or may be coated with a resin such as epoxy, acryl, polyester, urethane, melamine alkyd, and the like and may be then subjected to ultraviolet ray or infrared ray radiation to cure the resin, thereby manufacturing the tongue 3. As another example of the method of manufacturing the tongue 3, a conversion coating of zinc phosphate is formed on metal to serve as the base and, after that, a coating of a paint mixed with SUS powder, AL powder, or the like may be formed on the conversion coating, thereby also manufacturing the tongue 3. It should be noted that the method of manufacturing the tongue 3 is not limited thereto and the tongue 3 may be manufactured by other methods known in the art.

Hereinafter, the latching action between the buckle 1 and the tongue 3 in the seat belt apparatus employing the buckle 1 of this embodiment will be described. In the unlatched state where the tongue 3 is not inserted, as shown in FIG. 2(*a*), the slider 5 is in a position out of the lock pin 7 and the right faces of the pivot shaft portions 4*a*, 4*b* of the latch member 4 are in contact with portions 2*m*, 2*n* formed in the supporting groove 2*h*, 2*j* of the side walls 2*a*, 2*b* of the base 2. The latch member 4 and the slider 5 are in a state pivoting about the portions 2*m*, 2*n* upwardly (in the clockwise direction from the latched state shown in FIG. 2(*b*)). In this state, the latch member 4 is out of the insertion passage of the tongue 3, that is, in the unlatching position where the latch member 4 does not latch the tongue 3. In this state, the slider 5 is biased in a leftward and upward direction by biasing force of the slider spring 6 and is therefore held in a state that the left end of the slider 5 is in contact with the lock pin 7, while the latch member 4 is biased in the clockwise direction by the biasing force of the slider spring 6 and is therefore held in a state that the upper surface of the latch member 4 is in contact with the lower surface of the lock pin 7.

The ejector 10 is set at the leftmost position by the biasing force of the ejector spring 11. In the leftmost position of the ejector 10, the fifth and sixth pressing portions 10*f*, 10*g* of the ejector 10 are in contact with the right ends of the projecting portions 8*c* of the operation button 8 so as to bias the operation button 8 leftward. In this manner, the operation button 8 is held in the inoperative position.

When the buckle 1 is in the unlatched state, the slider 5 is positioned in the upper position so that the pressed portions 5*h*, 5*i* of the slider 5 are positioned not to face the first and second pressing portions 10*b*, 10*c* of the ejector 10, respectively. Both ends of the lever-side connecting portion 9*c* of the inertia lever 9 are in contact with the button-side connecting portions 8*e*.

As the tongue 3 is inserted through the tongue insertion opening 1*a* at the left end of the buckle 1 from the unlatched state of the buckle 1, shown in FIG. 2(*a*), the right end of the tongue 3 comes in contact with the left end of the ejector 10 and presses the ejector 10 rightward. As the ejector 10 moves rightward, compressing the ejector spring 11 with the insertion of the tongue 3, the third and fourth pressing portions 10*d*, 10*e* of the ejector 10 come in contact with the first and second pressed portions 4*d*, 4*e* of the latch member 4 and press the first and second pressed portions 4*d*, 4*e* rightward, whereby the latch member 4 and the slider 5 pivot downward (in the counterclockwise direction) about the portions 2*m*, 2*n*. Therefore, the latching portion 4*c* of the latch member 4 enters into the moving passage of the tongue 3 and is inserted into a latch hole 3*a* of the tongue 3 so that the latch member 4 is in the latching position.

As the inserting force on the tongue 3 is reacted to and compensated for, the ejector 10 presses the right end of the tongue 3 by the biasing force of the ejector spring 11 and the right end of the latch hole 3*a* of the tongue 3 is engaged with the latching portion 4*c*, whereby the tongue 3 is latched to the buckle 1. Thus, the tongue 3 and the buckle 1 attain the latched state shown in FIG. 2(*b*). In this state, since the left end of the ejector 10 is in contact with the right end of the tongue 3 and presses the tongue 3 leftward by the biasing force of the ejector spring 11, the engaging force between the tongue 3 and the latch member 4*c* is large and the latch member 4 is allowed to slightly move leftward so that the latch member 4 is spaced apart from the portions 2*m*, 2*m*.

As the slider 5 pivots in the counterclockwise direction, the slider 5 is allowed to enter the space under the lock pin 7. Then, the slider 5 enters the space under the lock pin 7 by the biasing force of the slider spring 6 so that the upper surface of the slider 5 is held down by the lock pin 7. Therefore, the slider 5 holds the latch member 4 in the latching position shown in FIG. 2(*b*) so that the latch member 4 is prevented from coming out of the latch hole 3*a* of the tongue 3. Accordingly, the latching between the tongue 3 and the buckle 1 is securely held. In addition, since the slider 5 is biased leftward by the biasing force of the slider spring 6, the engaging shafts 5*b*, 5*c* of the slider 5 press the pressing portions 8*f* of the operation button 8, whereby the operation button 8 is held in the inoperative position.

In the state that the buckle 1 and the tongue 3 are latched, the latching portion 4*c* is in contact with the right end of the inner periphery in the latch hole 3*a* of the tongue 3 and the left end of the ejector 10 is in contact with the right end of the tongue 3 so that the biasing force of the ejector spring 11 is applied to the latching portion 4*c* on the end of the latch member 4 via the ejector 10 and the tongue 3. Since the pressing portions 10*b*, 10*c* of the ejector 10 are spaced apart from the pressed portions 5*h*, 5*i* of the slider 5, however, the biasing force of the ejector spring 11 is not applied to the latched member 4 via the ejector 10 and the slider 5. Therefore, the biasing force of the ejector spring 11 to the latch member 4 in the latched state is relatively small.

As the operation button 8 is pressed rightward in an unlatching operation to cancel the latching from the state that the tongue 3 and the buckle 1 are latched, as shown in FIG. 2(*b*), the operation button 8 is moved rightward. Then, the pressing portions 8*f* of the operation button 8 press the engaging shafts 5*b*, 5*c* of the slider 5 so that the slider 5 moves rightward relative to the latch member 4, against the biasing force of the slider spring 6. The biasing force of the slider spring 6 is increased according to the unlatching operational force on the operation button 8. By the increased biasing force, the latch member 4 is biased in the unlatching direction (the clockwise direction).

Figure 5A:
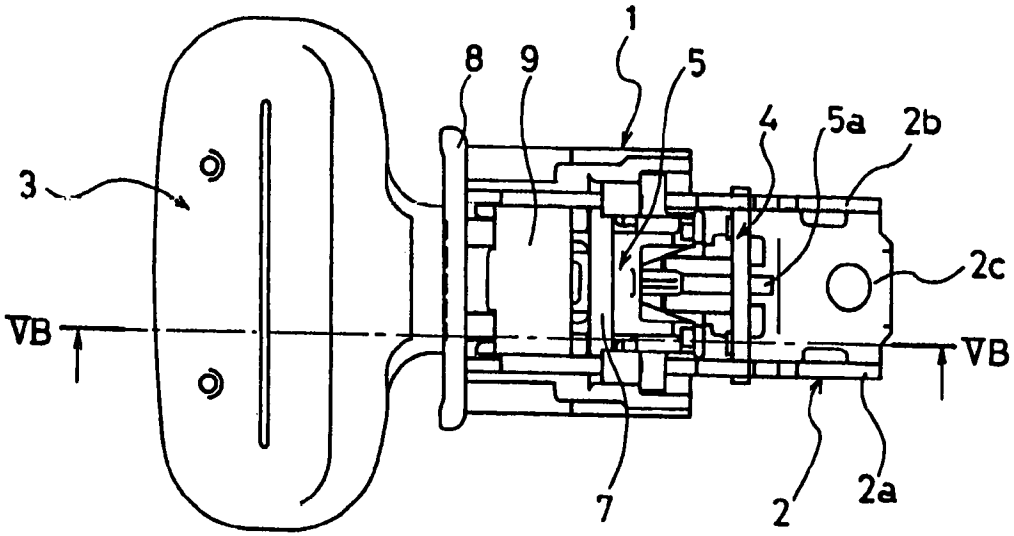
FIG. 5(*a*) is a plan view of the buckle shown in FIG. 1.
Figure 5B:
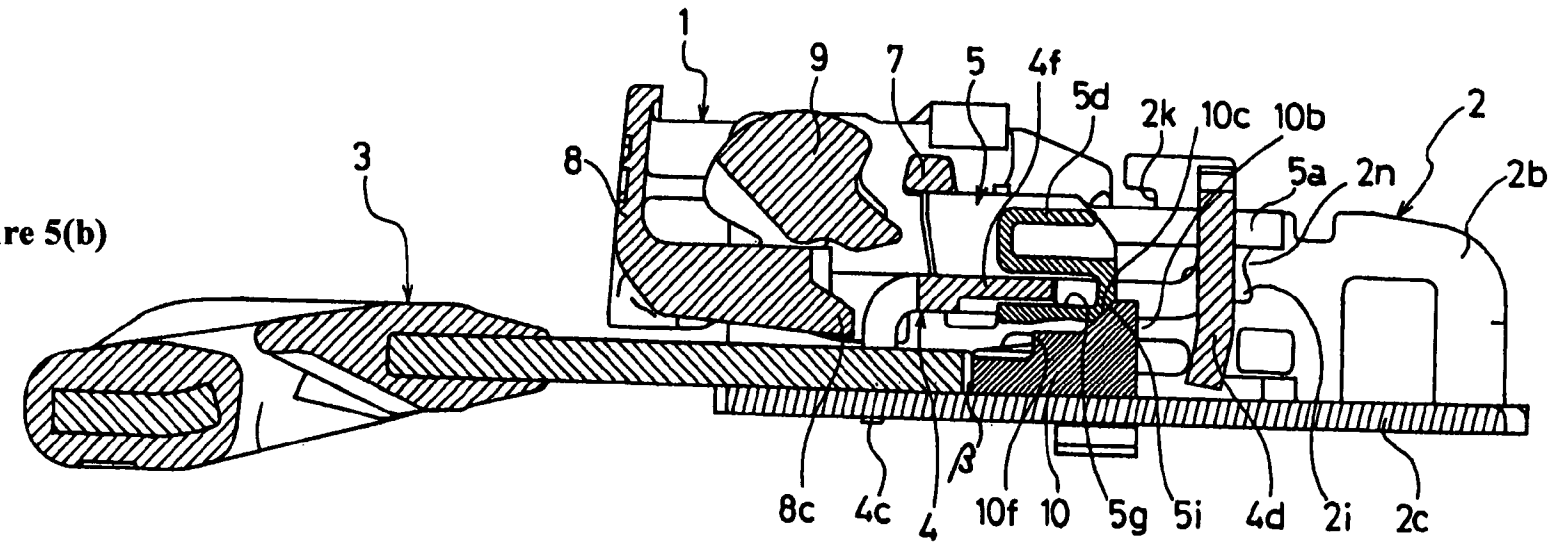

Then, as shown in FIGS. 5(*a*) and 5(*b*), the pressed portions 5*h*, 5*i* of the slider 5 come in contact with the first and second pressing portions 10*b*, 10*c* of the ejector 10 and press the first and second pressing portions 10*b*, 10*c* rightward. Since the pressed portions 5*h*, 5*i* and the first and second pressing portions 10*b*, 10*c* are inclined faces, the pressed portions 5*h*, 5*i* press the first and second pressing portions 10*b*, 10*c* in a direction perpendicular to the inclined faces. Accordingly, due a component of force in the longitudinal direction of the buckle by pressed portions 5*h*, 5*i* pressing the first and second pressing portions 10*b*, 10*c*, the ejector 10 is moved rightward against the biasing force of the ejector spring 11 so that the left end of the ejector 10 is spaced apart from the right end of the buckle 3. That is, a space β is formed between the right end of the tongue 3 and the left end of the ejector 10 so that the biasing force of the ejector spring 11 is not applied to the tongue 3. The engaging force between the tongue 3 and the latching portion 4*c* is reduced.

As the ejector 10 starts to move rightward, the ejector spring 11 is compressed so that the biasing force of the ejector spring 11 pressing the ejector 10 is increased according to the unlatching operational force of the operation button 8. Because of the reaction force due to the biasing force of the ejector spring 11, the pressed portions 5*h*, 5*i* are pressed by the first and second pressing portions 10*b*, 10*c*, respectively, in the direction perpendicular to the inclined faces. Therefore, the slider 5 and the latch member 4 are also biased together by the biasing force of the ejector spring 11 in the unlatching direction. In addition, by the wedging effect of the inclined faces of the first and second pressing portions 10*b*, 10*c*, force by the first and second pressing portions 10*b*, 10*c* is applied to the pressed portions 5*h*, 5*i*. However, just after the ejector 10 starts to move rightward, the slider 5 is positioned under the lock pin 7 so as not to allow the pivotal movement of the slider 5 and the latch member 4 in the clockwise direction.

As the slider 5 moves rightward, the engaging shafts 5*b*, 5*c* of the slider 5 come off from the first groove portions $2j_1$, $2k_1$ and the upper surface of the left end portion of the slider 5 comes off from under the lock pin 7 so that the slider 5 is no longer held down by the lock pin 7. Therefore, the slider 5 allows a pivotal movement of the latch member 4 in the unlatching direction (the clockwise direction).

Then, the slider 5 and the latch member 4 pivot about the portions 2*m*, 2*n* by the biasing force of the ejector spring 11 via the first and second pressing portion 10*b*, 10*c* and the pressed portions 5*h*, 5*i* so that the latching portion 4*c* moves upward and comes off from the latch hole 3*a* of the tongue 3. At this time, the biasing force of the ejector spring 11 is increased and the left end of the ejector 10 is spaced apart from the right end of the tongue 3, whereby the engaging force between the ejector 10 and the tongue 3 no longer exists and the engaging force between the tongue 3 and the latching portion 4*c* is reduced. Accordingly, the latching portion 4*c* smoothly comes off from the latch hole 3*a* of the tongue 3.

As the slider 5 and the latch member 4 further pivot in the clockwise direction and the pressed portions 5*h*, 5*i* are spaced from the first and second pressing portions 10*b*, 10*c*, the left end of the ejector 10 comes in contact with the right end of the tongue 3 and the ejector 10 pushes the tongue 3 out from the buckle 1 leftward by the biasing force of the ejector spring 11.

As the upper surface of the latch member 4 on the latching portion 4*c* side comes in contact with the lock pin 7 as shown in FIG. 2(*a*), the latch member 4 and the slider 5 stop from pivoting in the clockwise direction. As the unlatching operational force applied to the operation button 8 is canceled, the slider 5 and the operation button 8 move leftward by the biasing force of the slider spring 6. Then, the slider 5 reaches a position being in contact with the lock pin 7 and the operation button 8 reaches the inoperative position. Finally, the ejector 10 reaches the leftmost position and the latch member 4 reaches the inoperative position so that the buckle 1 attains the unlatched state when the tongue 3 is released from the buckle 1.

According to the buckle 1 of this embodiment, when the slider 5 moves in the unlatching direction by the unlatching operation with the operation button 8 moving from the latched state, the pressed portions 5*h*, 5*i* of the slider 5 come in contact with the pressing portions 10*b*, 10*c* of the ejector 10 and move the ejector 10 rightward against the biasing force of the ejector spring 11 so as to space the ejector 10 from the tongue 3 when the tongue 3 is unlatched from the latching portion 4*c*. Therefore, the engaging force between the tongue 3 and the latching portion 4*c* may be reduced when releasing the tongue 3. In addition, the pressing portions 10*b*, 10*c* of the ejector 10 press the pressed portions 5*h*, 5*i* of the slider 5 by reaction force of the biasing force of the ejector spring 11, whereby the latch member 4 can effectively pivot in the unlatching direction. In this connection, since the biasing force of the ejector spring 11 is increased due to the rightward movement of the ejector 10, the force by the pressing portions 10*b*, 10*c* of the ejector 10 for making the latch member 4 to pivot in the unlatching direction is also increased. Therefore, the engaging force for the tongue 3 and the latching portion 4*c* and these parts may be released by the increased force, thereby improving the releasing performance between the tongue 3 and the buckle 1.

Even without increasing the angle of inclination of a line connecting the latching portion 4*c* and the pivot shaft portions 4*a*, 4*b* (pivotal axis) of the latch member 4, the moving force of the latch member 4 in the unlatching direction can be increased. Therefore, the pivot path of the end of the latching portion 4*c* does not project largely forward, thereby allowing the length of the buckle 1 in the longitudinal direction to be compact.

Because the pressing portions 10*b*, 10*c* apply unlatching force to the slider 5 only when the slider 5 allows the latch member 4 to move in the unlatching direction, the ejector 10 never applies unlatching force to the slider 5 when the latch member 4 is in the latched state. Therefore, even through the unlatching force is effectively applied to the latch member 4, it is not required to increase the strength of the slider 5 and the lock pin 7 to be more than that of the conventional one.

Because the unlatching force applying portion applies unlatching force to the slider when the slider allows the movement of the latch member in the unlatching direction, the unlatching force is never applied to the slider when the latch member is in the latched state. Therefore, even though the unlatching force can be effectively applied to the latch member, it is not required to increase the strength of the slider compared to the conventional one.

Since the pressing portions 10*b*, 10*c* of the ejector 10 and the pressed portions 5*h*, 5*i* of the slider 5 are composed of inclined faces, the unlatching force can be increased by the wedging effect of these inclined faces, thereby further improving the releasing performance between the tongue 3 and the buckle 1. In addition, by suitably setting the angle of inclination of these inclined faces, the unlatching force can be suitably adjusted.

Since the angle of inclination of the inclined faces may be set such that an extension line of the inclined faces passes through or close to the pivotal axis of the latch member 4 when the pressed portions 5*h*, 5*i* of the slider 5 come in contact with the pressing portions 10*b*, 10*c* of the ejector 10, the unlatching force may be applied from the ejector 10 to the latch member 4 in a direction perpendicular or substantially perpendicular to the inclined faces. Therefore, the unlatching force can be effectively applied, thereby further improving the releasing performance between the tongue 3 and the buckle 1.

Since the biasing force of the ejector spring 11 can be effectively used for the pivotal movement of the latch member 4 in the unlatching direction, the need of a special means for increasing the unlatching force can be eliminated. In addition, the diameter and the biasing force of the slider spring 6 for biasing the latch member 4 in the unlatching direction may be reduced, thereby reducing the cost of the slider spring 6.

According to the seat belt apparatus of the present invention, when the buckle 1 of the present invention is employed, the releasing performance between the tongue 3 and the buckle 1 is improved as mentioned above, thereby improving the comfort when wearing the seat belt.

Further, since the engaging force between the tongue 3 and the latching portion 4*c* can be reduced when releasing the tongue 3, a tongue 3 manufactured by the aforementioned method may have sufficient durability. Because the tongue 3 may be manufactured by the aforementioned method, the cost of the tongue 3 can be reduced.

Though the pressing portions 10*b*, 10*c* of the ejector 10 and the pressed portions 5*h*, 5*i* of the slider 5 are composed of inclined faces, respectively in the aforementioned embodiment, the pressing portions 10*b*, 10*c* and the pressed portions 5*h*, 5*i* may instead be composed of different shapes. For example, arc-shaped faces may be used. Preferably, either of the pressing portions 10*b*, 10*c* and the pressed portions 5*h*, 5*i* are composed of inclined faces. In addition, by suitably setting the angle of inclination of the inclined face, the unlatching force can be suitably adjusted.

According to an embodiment of the present invention, the angle of inclination of the inclined face is set such that the extension line of the inclined face passes through or close to the pivotal axis of the latch member when the contact portion of the slider comes in contact with the unlatching force applying portion so that the unlatching force can be effectively applied from the ejector to the latch member, thereby further improving the releasing performance between the tongue and the buckle.

The seat belt apparatus of the present invention can be used to a seat belt apparatus installed to a seat of an automobile or other traffic vehicle.

The priority application, Japanese Patent Application No. 2004-147319 filed on May 18, 2005, is hereby incorporated by reference herein in its entirety.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A buckle, comprising:

a base having side walls;

a latch member supported by the side walls so that the latch member can pivot between an unlatching position and a latching position, wherein the latch member includes a latching portion which is configured to engage with a tongue when the tongue is inserted into a predetermined position within the buckle and the latch member pivots to the latching position;

a slider that is configured to prevent said latch member from moving in the unlatching direction when the tongue and the latch member are latched;

a slider spring which is disposed between the slider and the latch member and is configured to be compressed by the slider and the latch member;

an operation member which is attached to said side walls of the base such that the operation member can move in the longitudinal direction of the buckle, and is configured to cause said slider to move in the unlatching direction of said latch member by an unlatching operation;

an ejector for releasing said tongue;

an ejector spring for biasing said ejector in a direction to release the tongue; and wherein said slider is supported to said latch member so as to allow relative movement, and said ejector includes an unlatching force applying portion that is configured to apply the unlatching force to said slider by directly contacting the slider when said latch member is caused to move in the unlatching direction by the movement of said slider relative to said latch member due to the unlatching operation of said operation member.

2. The buckle as claimed in claim 1, wherein said slider includes a contact portion which comes in contact with the unlatching force applying portion of said ejector when said slider is moved by the unlatching operation of said operation member, and wherein at least one of said unlatching force applying portion and said contact portion is composed of an inclined face.

3. The buckle as claimed in claim 2, wherein the angle of inclination of said inclined face is set such that an extension line of said inclined face passes through or close to a pivotal axis of said latch member when said contact portion of the slider is in contact with said unlatching force applying portion due to the unlatching operation of said operation member.

4. The buckle as claimed in claim 2, wherein the unlatching force applied to the contact portion of said slider by the unlatching force applying portion causes said slider and said latch member to move in the unlatching direction, thereby causing the contact portion and unlatching force applying portion to become spaced apart and said ejector to contact an end of the tongue and push the tongue out from the buckle.

5. The buckle as claimed in claim 2, wherein said ejector spring is configured to produce said unlatching force due to a biasing force of said ejector spring.

6. The buckle as claimed in claim 5, wherein during the unlatching operation due to the operation member said ejector becomes spaced apart from said tongue and said slider and said latch member move in the unlatching direction after the contact portion of said slider comes in contact with said unlatching force applying portion.

7. The buckle as claimed in claim 1, further comprising a lock pin connected to said side walls of said base, wherein said slider is positioned underneath said lock pin when said latch member is in the latching position, and wherein the slider is released from beneath said lock pin when said latch pin pivots to the unlatching position.

8. The buckle as claimed in claim 1, further comprising:

engaging grooves formed in the side walls of the base, wherein the engaging grooves include first groove portions extending the longitudinal direction of the buckle and second groove portions extending obliquely to the longitudinal direction of the buckle;

engaging shafts on the slider for engaging with the engaging grooves;

wherein the engaging shafts move along the first groove portions during normal operation of the buckle, and wherein the engaging shafts move from the first groove portions to the second groove portions during the unlatching operation.

9. A seat belt device, comprising:

a seat belt to be worn by an occupant;

a tongue movably supported to the seat belt;

a buckle to which the tongue is latched, in which the tongue is latched to the buckle whereby the seat belt is fastened to the occupant;

wherein the buckle includes: a base having side walls;

a latch member supported by the side walls so that the latch member can pivot between an unlatching position and a latching position, wherein the latch member includes a latching portion which is configured to engage with a tongue when the tongue is inserted into a predetermined position within the buckle and the latch member pivots to the latching position;

a slider that is configured to prevent said latch member from moving in the unlatching direction when the tongue and the latch member are latched;

a slider spring which is disposed between the slider and the latch member and is configured to be compressed by the slider and the latch member;

an operation member which is attached to said side walls of the base such that the operation member can move in the longitudinal direction of the buckle, and is configured to cause said slider to move in the unlatching direction of said latch member by an unlatching operation;

an ejector for releasing said tongue;

an ejector spring for biasing said ejector in a direction to release the tongue; and wherein said slider is supported to said latch member so as to allow relative movement, and said ejector includes an unlatching force applying portion that is configured to apply the unlatching force to said slider by directly contactinu the slider when said latch member is caused to move in the unlatching direction by the movement of said slider relative to said latch member due to the unlatching operation of said operation member.

10. The seat belt device as claimed in claim 9, wherein said slider includes a contact portion which comes in contact with the unlatching force applying portion of said ejector when said slider is moved by the unlatching operation of said operation member, and wherein at least one of said unlatching force applying portion and said contact portion is composed of an inclined face.

11. The seat belt device as claimed in claim 10, wherein the angle of inclination of said inclined face is set such that an extension line of said inclined face passes through or close to a pivotal axis of said latch member when said contact portion of the slider is in contact with said unlatching force applying portion due to the unlatching operation of said operation member.

12. The seat belt device as claimed in claim 10, wherein the unlatching force applied to the contact portion of said slider by the unlatching force applying portion causes said slider and said latch member to move in the unlatching direction, thereby causing the contact portion and unlatching force applying portion to become spaced apart and said ejector to contact an end of the tongue and push the tongue out from the buckle.

13. The seat belt device as claimed in claim 10, wherein said ejector spring is configured to produce said unlatching force due to a biasing force of said ejector spring.

14. The seat belt device as claimed in claim 13, wherein during the unlatching operation due to the operation member said ejector becomes spaced apart from said tongue and said slider and said latch member move in the unlatching direction after the contact portion of said slider comes in contact with said unlatching force applying portion.

15. The seat belt device as claimed in claim 9, further comprising a lock pin connected to said side walls of said base, wherein said slider is positioned underneath said lock pin when said latch member is in the latching position, and wherein the slider is released from beneath said lock pin when said latch pin pivots to the unlatching position.

16. The seat belt device as claimed in claim 9, further comprising:

engaging grooves formed in the side walls of the base, wherein the engaging grooves include first groove portions extending the longitudinal direction of the buckle and second groove portions extending obliquely to the longitudinal direction of the buckle;

engaging shafts on the slider for engaging with the engaging grooves;

wherein the engaging shafts move along the first groove portions during normal operation of the buckle, and wherein the engaging shafts move from the first groove portions to the second groove portions during the unlatching operation.

* * * * *